US007796006B2

(12) United States Patent
Chen et al.

(10) Patent No.: US 7,796,006 B2
(45) Date of Patent: Sep. 14, 2010

(54) SUSPENSION INDUCTOR DEVICES

(75) Inventors: Wei-Ting Chen, Tainan County (TW); Chang-Sheng Chen, Taipei (TW); Chin-Sun Shyu, Pingtung Hsien (TW); Chang-Lin Wei, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 12/143,653

(22) Filed: Jun. 20, 2008

(65) Prior Publication Data

US 2009/0058589 A1 Mar. 5, 2009

(30) Foreign Application Priority Data

Aug. 29, 2007 (TW) ..... 96132005 A

(51) Int. Cl.

| | |
|---|---|
| ***H01F 5/00*** | (2006.01) |
| ***H01F 27/29*** | (2006.01) |
| ***H01F 27/28*** | (2006.01) |
| ***H01F 21/02*** | (2006.01) |

(52) U.S. Cl. ..... 336/200; 336/192; 336/223; 336/147

(58) Field of Classification Search ..... None
See application file for complete search history.

(56) References Cited

U.S. PATENT DOCUMENTS

| | | | | |
|---|---|---|---|---|
| 5,373,112 | A * | 12/1994 | Kamimura et al. | 174/255 |
| 5,461,353 | A | 10/1995 | Eberhardt | |
| 5,612,660 | A * | 3/1997 | Takimoto | 336/200 |
| 6,075,427 | A * | 6/2000 | Tai et al. | 333/219 |
| 6,384,706 | B1 | 5/2002 | Iwanami | |
| 6,480,086 | B1 * | 11/2002 | Kluge et al. | 336/200 |
| 6,713,162 | B2 * | 3/2004 | Takaya et al. | 428/209 |
| 6,717,503 | B2 * | 4/2004 | Berthold et al. | 336/200 |
| 6,839,955 | B2 * | 1/2005 | Uchikoba et al. | 29/602.1 |
| 6,847,282 | B2 | 1/2005 | Gomez et al. | |
| 7,026,904 | B2 * | 4/2006 | Gomez et al. | 336/200 |
| 7,151,298 | B1 * | 12/2006 | Eggert et al. | 257/355 |
| 7,167,072 | B2 * | 1/2007 | Hung et al. | 336/200 |
| 7,176,776 | B1 * | 2/2007 | Tantwai et al. | 336/200 |
| 7,486,168 | B2 * | 2/2009 | Kim | 336/200 |
| 2005/0174208 | A1 * | 8/2005 | Sato et al. | 336/200 |
| 2006/0202789 | A1 * | 9/2006 | Hyvonen | 336/200 |
| 2007/0090911 | A1 * | 4/2007 | Lee | 336/200 |

* cited by examiner

*Primary Examiner*—Lincoln Donovan
*Assistant Examiner*—Mangtin Lian

(57) ABSTRACT

Suspension inductor devices are provided. A suspension inductor device includes a dielectric substrate and a suspension induction coil. The suspension induction coil includes an input end disposed on the dielectric substrate. A spiral coil is wound from the dielectric substrate to an interconnection. The interconnection is disposed in the spiral coil and connects the input end and the spiral coil. An output end is disposed on the dielectric substrate and adjacent to the input end.

35 Claims, 20 Drawing Sheets

SUSPENSION INDUCTOR DEVICES

CROSS REFERENCE TO RELATED APPLICATIONS

This application is based upon and claims the benefit of priority from a prior Taiwanese Patent Application No. 096132005, filed on Aug. 29, 2007, the entire contents of which are incorporated herein by reference.

BACKGROUND OF THE INVENTION

1. Field of the Invention

The invention relates to suspension inductor devices; and in particular to suspension inductor devices with high inductance.

2. Description of the Related Art

For high frequency design applications, both DC and high frequency signals play equally important roles. DC signals can provide an operational active circuit within a typical working frequency range such that it can deal with transmission of high frequency signals such as amplified signals, and can reduce noise index and conduct high power transmissions. Meanwhile, the active circuit can transmit data with high frequencies. Theoretically, the DC signal and high frequency are operationally independent with each other. In practice, however, the DC signal levels are often shifted due to high frequency signal perturbations such that the operational active circuit cannot work within the typical working frequency ranges. Moreover, the DC signal always introduces various noises such that the high frequency signal is mixed with undesired additional noises resulting in demodulation failure by communication systems.

Generally, the equivalent impedance of an inductor increases as frequency rises, which can be indicated by Eq. 1:

$$Z=jwL \quad w=2\times\pi\times\text{freq} \quad L=\text{inductance} \qquad \text{Eq. 1}$$

The equivalent impedance of an inductor, therefore, will become very large at high frequency blocking transmissions of signal. Since the DC signal theoretically does not have frequency and its equivalent impedance is very small, the DC signal can successfully pass through the inductor. As a result, the inductor can function as a separator, separating the DC and high frequency signals to ensure the circuit system operates normally. Additionally, when designing a relatively lower frequency (~MHz) circuit, inductors with high inductance are needed to achieve high impedance due to its relatively lower operational frequency. Alternatively, when designing a high power circuit, inductors with high inductance are needed to block out high frequency signals preventing signal leakage to the current terminal. Inductors with high inductance are thus indispensable in circuit design and application.

Conventional inductor devices, however, require a larger layout area to fulfill high inductance effects, while a larger layout area causes undesirable signal losses. For example, the characteristic equivalent impedance model for transmission lines can be indicted by Eq. 2:

$$Z_0 = \frac{120\pi}{\sqrt{\varepsilon_e}\left[\frac{W}{d} + 1.39. + 0.667\ln\left(\frac{W}{d}\right) + 1.444\right]} \qquad \text{Eq. 2}$$

If inductor devices with higher impedance or higher inductance are desirably achieved, a thicker substrate or thinner transmission lines are required. Alternatively, coupling capability of the inductor coil has to be improved, as indicated by Eq. 3:

$$L_{21} = \frac{\mu_0}{4\pi}\oint_{S1}\oint_{S2}\frac{\vec{d\ell_1}\cdot\vec{d\ell_2}}{R} = L_{12} \quad \mu_0\text{: Air permeability} \qquad \text{Eq. 3}$$

Inductance of an inductor can be defined by mutual inductance and self inductance. On an inductor coil, self inductance is unaffected by skin effect at very low frequencies, therefore, only mutual inductance will be discussed hereinafter. Referring to FIG. 1, two coils S1 and S2 with electric currents are mutually inducted creating an inductance which can be derived from the Neumann formula for mutual inductance as indicted by Eq. 3. Thus, inductance can be improved by reducing the interval R between the two coils S1 and S2 or enlargement of the area of each of the coils S1 and S2.

Moreover, large area layout of the transmission lines can result in high equivalent impedance such that the quality factor of the inductor with high inductance is hindered, which is indicated by Eq. 4:

$$Q = \frac{2\pi\times\text{The maximum stored energy}}{\text{The energy dissipated per cycle}} \qquad \text{Eq. 4}$$

Increasing equivalent impedance will cause an increase of energy dissipation, thereby deteriorating quality factor of the inductor. The input end and output end of a two-port inductor with a large area layout can cause a distance issue during circuit system layout, thus increasing difficulty. Further, as both the desirability for higher density and smaller area of transmission lines increase, fabrication processes encounter various technical difficulties.

U.S. Pat. No. 5,461,353, the entirety of which is hereby incorporated by reference, discloses a tunable embedded inductor structure. Referring to FIG. 2, a tunable coil 10 is embedded in a multi-layered substrate structure. A transistor 18 is controlled by a control signal from a control line 15 to electrically short two adjacent conductive interconnections 14 and 16, thereby regulating inductance of the coil 10. Metal layers functioning as shielding inductance are disposed on the top and bottom of the multi-layered substrate structure, respectively. The advantageous feature is the capability of turning inductance and having a superb quality factor due to distribution of the electromagnetic field confined within the spiral coil. A large circuit layout area, however, is needed to achieve coils with high inductance. Since the input end and the output end of the coil are separated very far apart, a very large circuit layout area is occupied during fabrication of the two-port inductor device.

Further, U.S. Pat. No. 6,384,706, the entirety of which is hereby incorporated by reference, discloses an inductor structure layout with a plurality of planar spiral coils on different layers of a substrate. Each planar spiral coil is connected to each other through conductive interconnections. Referring to FIG. 3A, an inductor device 20 includes a substrate structure composed of a plurality of dielectric layers 25. Two planar spiral coils 26*a* and 26*b* are disposed in the substrate structure and connected to each other through an interconnection 27 to improve inductance. The cross section of the inductor device 20 is shown in FIG. 3B. The substrate structure further includes a power source line 24, a ground line 23, and signal lines 22 all of which are connected by contact lines 31 and controlled by integrated circuits 32*a*, 32*b* and capacitors 33*a*, 33*b*. The abovementioned large inductance coil structure has a deteriorated quality factor due to being prone to electromagnet radiation. Since the input end and the output end of the coil are not disposed on the same layer, which is detrimental to circuit layout, additional conductive lines or interconnections are required to close the input and output ends.

U.S. Pat. No. 6,847,282, the entirety of which is hereby incorporated by reference, discloses a circuit layout with transmission lines disposed on a multi-layered substrate. The transmission lines on each substrate layer are connected through through-holes, blind-holes, or buried-holes, thereby completing a stereographic inductor structure. Referring to FIGS. 4A and 4B, multiple spiral coils 51, 52, 54, and 56 are separately disposed on surfaces 53, 55, 57, and 59 of the laminated dielectric substrate. Each of the multiple spiral coils are connected through conductive interconnections 62, 64, and 66. A patterned shield on the bottom surface of the laminated dielectric substrate serving as ground can effectively block inductance interference. Such an inductor device structure can reduce circuit layout area and maintain high inductance and quality factor. The input end and the output end of the coil are not disposed on the same layer, which is detrimental to circuit layout. Thus, additional conductive lines or interconnections 67 are required to close the input and output ends.

BRIEF SUMMARY OF THE INVENTION

The invention relates to suspension inductor devices with high inductance and quality factor characteristics. Circuit layout area of the suspension inductor devices can be further reduced. The suspension inductor devices are advantageous as the devices have improved circuit system performance and reduced circuit layout area.

Embodiments of the invention provide a suspension inductor device comprising a dielectric substrate and a suspension induction coil. The suspension induction coil comprises: an input end disposed on the dielectric substrate; a spiral coil wound from the dielectric substrate to an interconnection; the interconnection passing through the dielectric substrate and disposed in the spiral coil, connecting from the input end to the spiral coil; and an output end disposed on the dielectric substrate and adjacent to the input end.

Embodiments of the invention further provide a suspension inductor device, comprising: a dielectric substrate with a multilayer of sub-substrates; an input end disposed on the dielectric substrate; a spiral coil wound from the dielectric substrate to an interconnection, wherein the spiral coil comprises at least one turn of coil, any coil having a winding segment on one of the sub-substrates, and a conductive hole passing through the sub-substrate connecting to a winding segment of the next turn of coil; the interconnection passing through the dielectric substrate and disposed in the spiral coil, connecting from the input end to the spiral coil; and an output end disposed on the dielectric substrate and adjacent to the input end.

BRIEF DESCRIPTION OF THE DRAWINGS

The invention can be more fully understood by reading the subsequent detailed description and examples with references made to the accompanying drawings, wherein:

FIG. 10A is a stereographic view of a conventional spiral inductor device, while

FIG. 11A is a stereographic view of one embodiment of the suspension spiral inductor device of the invention, while

DETAILED DESCRIPTION OF THE INVENTION

Figure 1:
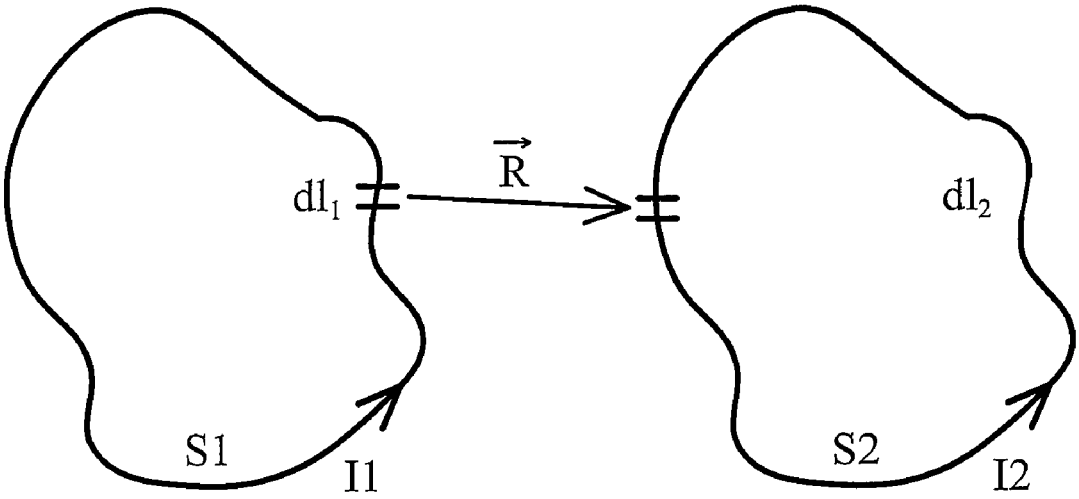
FIG. 1 ( PRIOR ART )
FIG. 1 is a schematic view of conventional two coils S1 and S2 being mutually inducted creating an inductance with electric currents.
Figure 2:
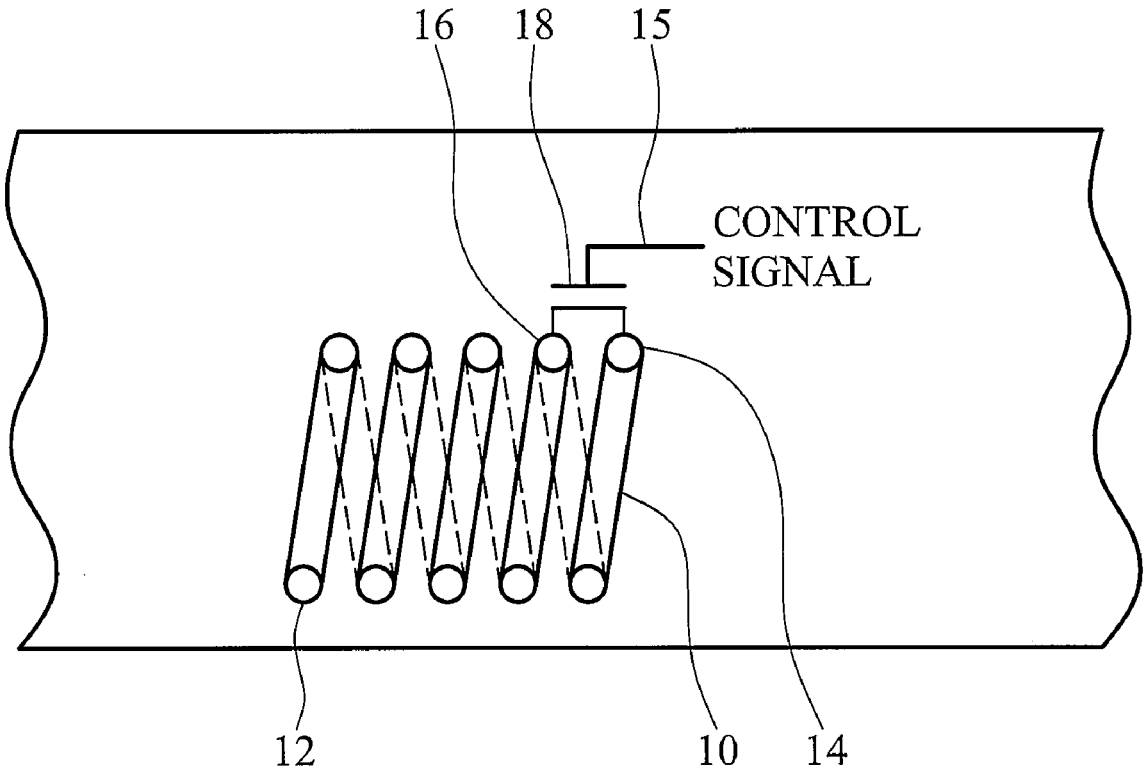
FIG. 2 ( PRIOR ART )
FIG. 2 is a schematic view of a conventional inductor device with a tunable coil.
Figure 3A:
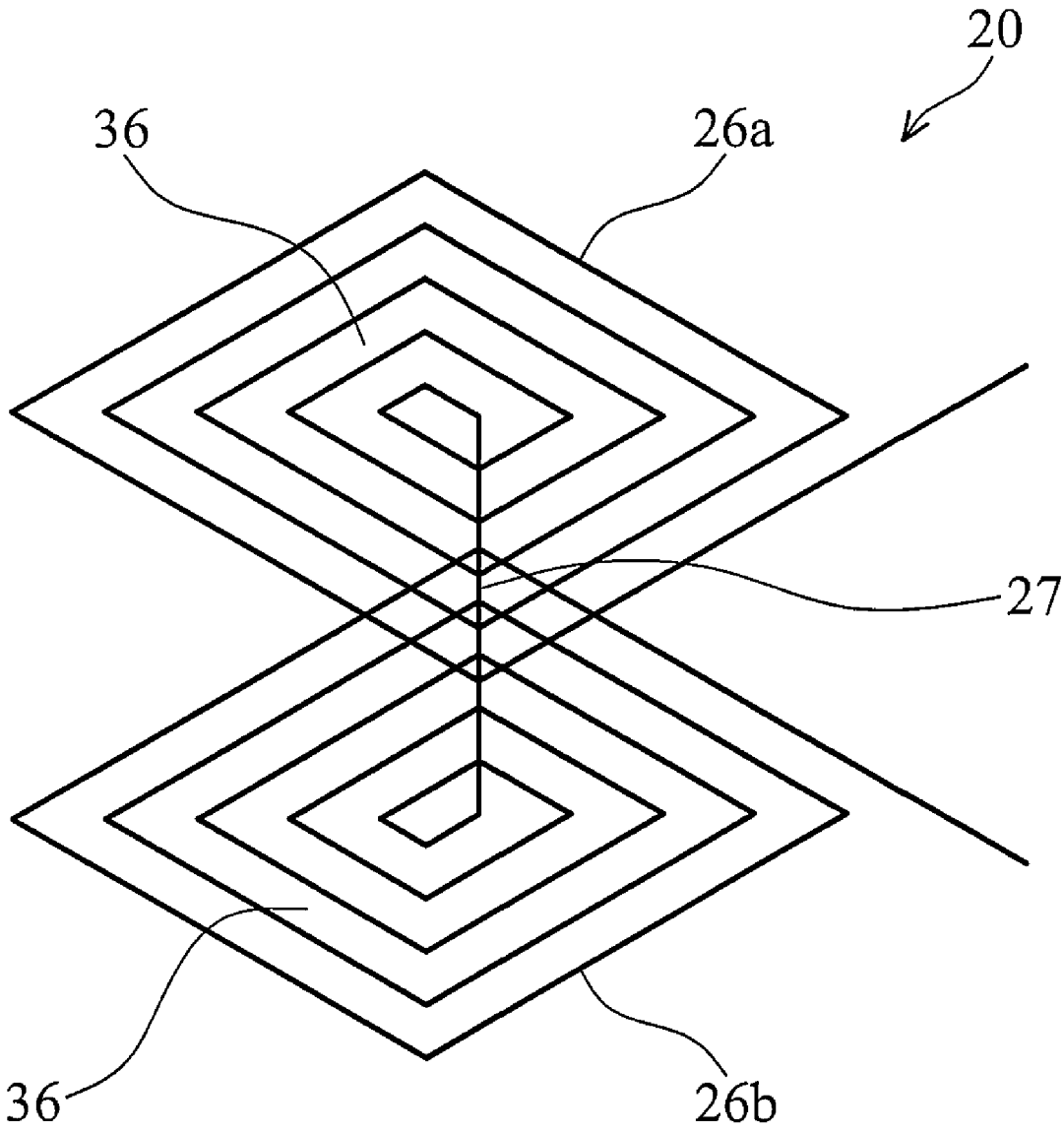
FIG. 3A ( PRIOR ART )
FIG. 3A is a schematic view of two individual planar spiral inductor devices on different layers of a substrate.
Figure 3B:
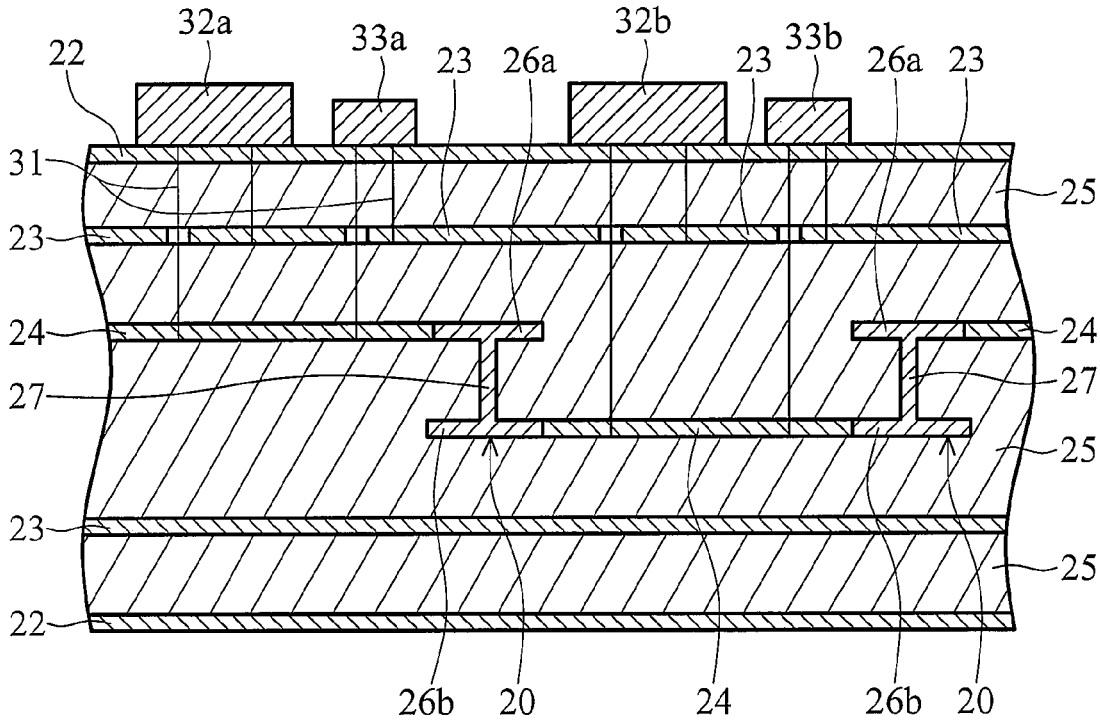
FIG. 3B ( PRIOR ART )
FIG. 3B is a cross section of two individual planar spiral inductor devices of FIG. 3A.
Figure 4A:
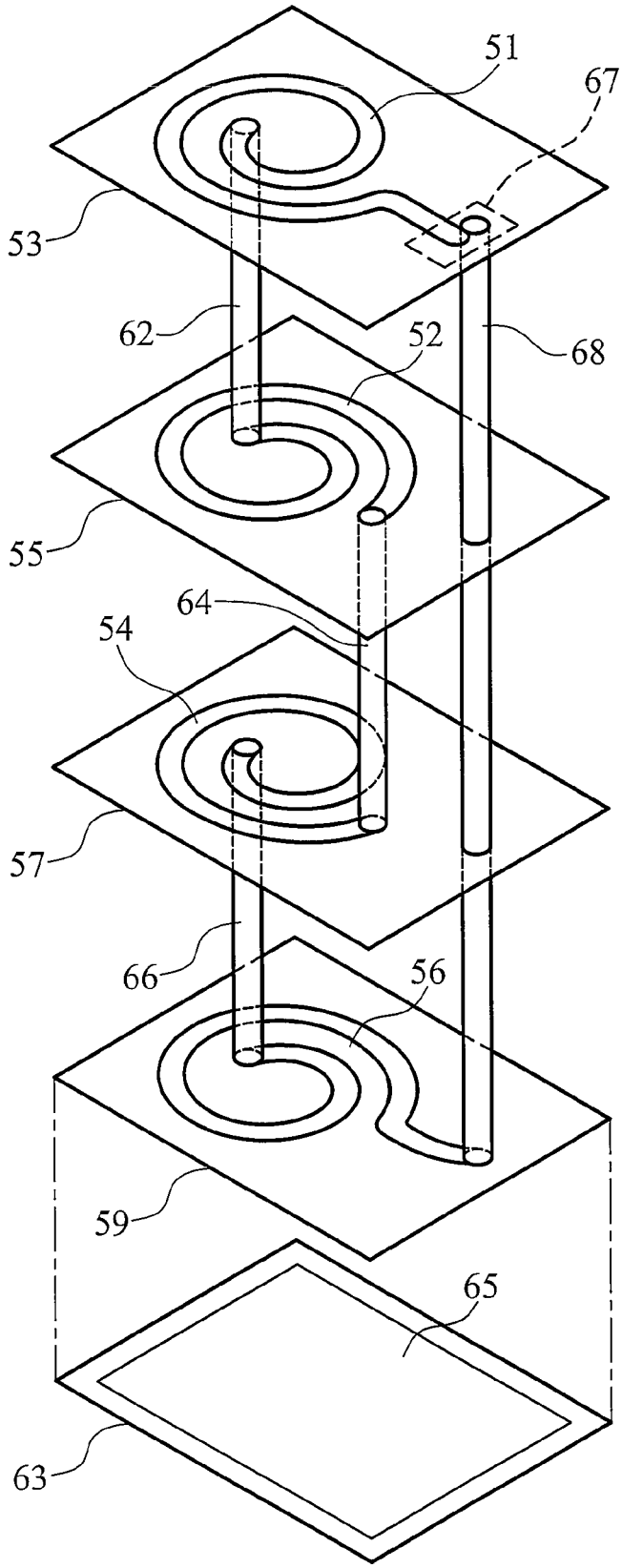
FIG. 4A ( PRIOR ART )
FIG. 4A is a schematic view of a conventional stereographic inductor device in multi-layered substrates.
Figure 4B:
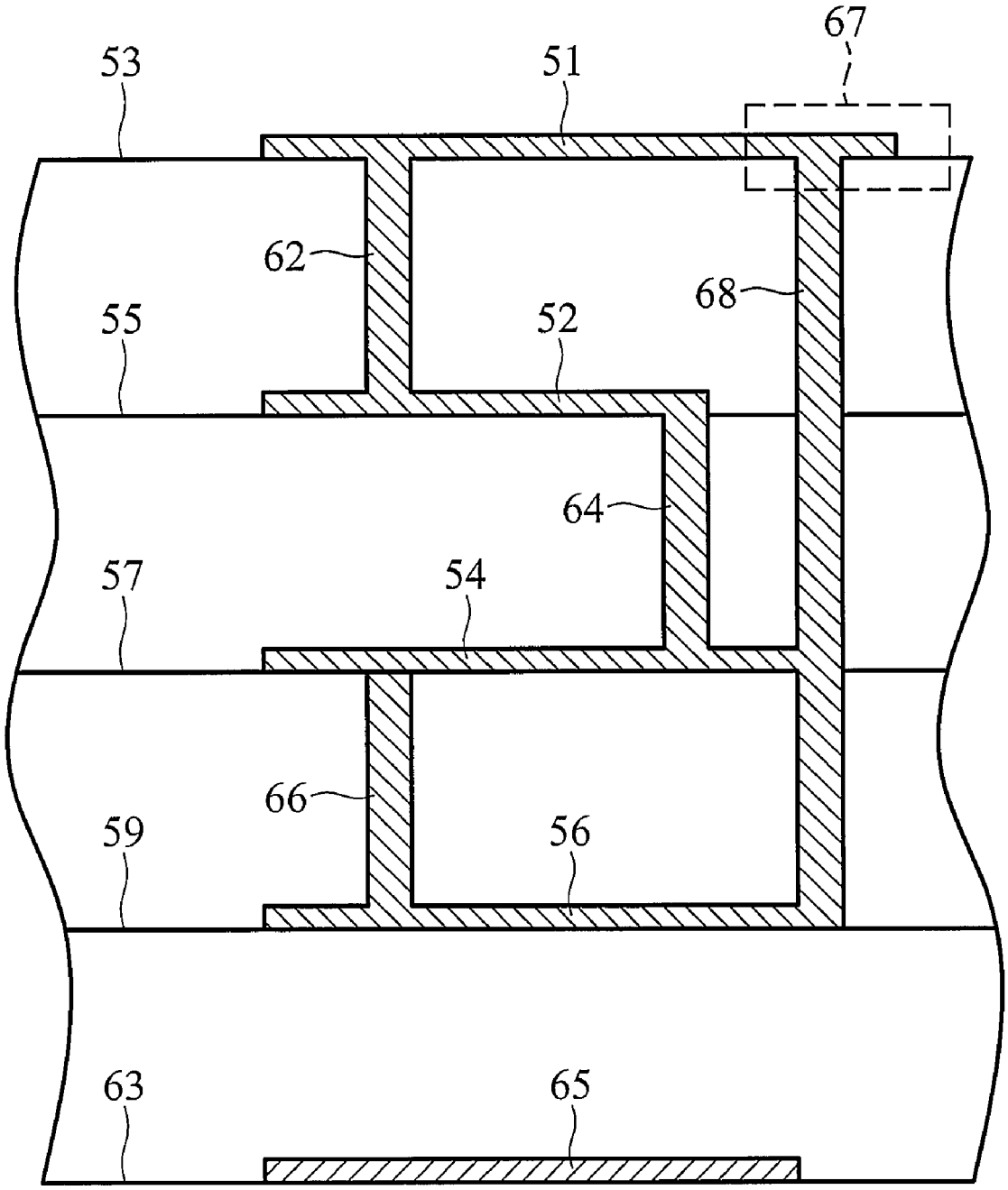
FIG. 4B ( PRIOR ART )
FIG. 4B is a cross section of the stereographic inductor device in multi-layered substrates of FIG. 4A.

A detailed description is given in the following embodiments with reference to the accompanying drawings.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

Main features and key aspects of a stereographic suspension induction device with reduced circuit layout area, and high inductance and quality factor is provided. The electromagnetic field distribution is concentrated in the central region of the stereographic suspension induction device, thereby solving large layout area and energy loss issues. Moreover, the suspension induction device can reduce electromagnetic radiation and energy loss to improve quality factor. Concerning layout of the two-port inductor, this inductor structure can easily change locations of the input and output ends, thereby allowing various layouts of the suspension induction device.

Figure 5:
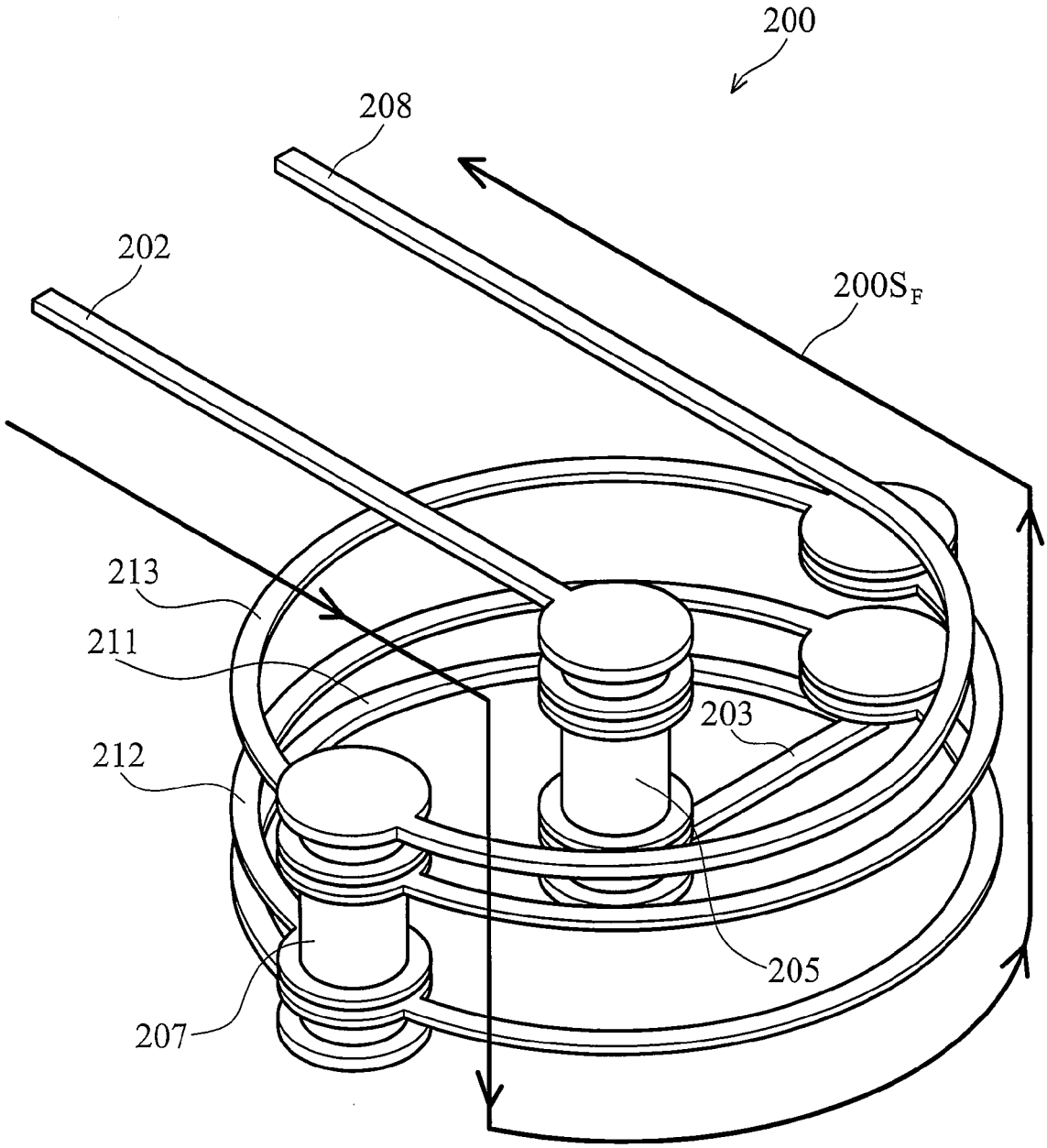
FIG. 5 is a stereographic view of an embodiment of the suspension induction device of the invention.

FIG. 5 is a stereographic view of an embodiment of the suspension induction device of the invention. Referring to FIG. 5, a suspension induction coil 200 includes an input end 202 disposed on a first surface of a dielectric substrate. The input end 202 connects an interconnection 205 through the dielectric substrate and further electrically connects a spiral coil through a conductive segment 203. The interconnection 205 can include through holes, blind holes, or buried holes. The interconnection 205 is disposed with the central area of the spiral coil. For example, the interconnection 205 can be disposed at the center of the spiral coil to concentrate electromagnetic field distribution within the spiral coil, thereby reducing electromagnetic radiation loss and improving quality factor of the suspension inductor device. The spiral coil is wound from a second surface (e.g., bottom surface) of the dielectric substrate upwards to the first surface and is connected to an output end 208 on the first surface of a dielectric substrate. The spiral coil includes a plurality of turns of windings 211, 212, and 213. Each winding is connected to each other by the interconnection 207. Note that the input end 202 of the suspension induction coil 200 is adjacent to the output 208, reducing the circuit layout area, thereby further facilitating integration with other active and passive devices.

It should be understood that the suspension induction coil 200 can be a rectangular spiral coil, a polygonal spiral coil, or a circular spiral coil. Alternatively, the suspension induction coil 200 can be clockwise wound or counterclockwise wound.

According to embodiments of the invention, during operation, signals 200$S_F$ is transmitted from the input end to the conductive hole passing through the substrate, and is further transmitted to the spiral coil in the multi-layered substrate, such that output signals can return back the output end which is adjacent to the input end through blind holes or buried holes. The abovementioned inductor structure can reduce layout area consumption and achieve high inductance. The locations of input and output ends of the two-port inductor device can be easily changed to provide more design margins for system circuit layout. Further, the stereographic suspension inductor can concentrate electromagnetic field distribution in the central region of the spiral coil, thereby reducing electromagnetic radiation and energy loss and improving quality factor.

Figure 6:
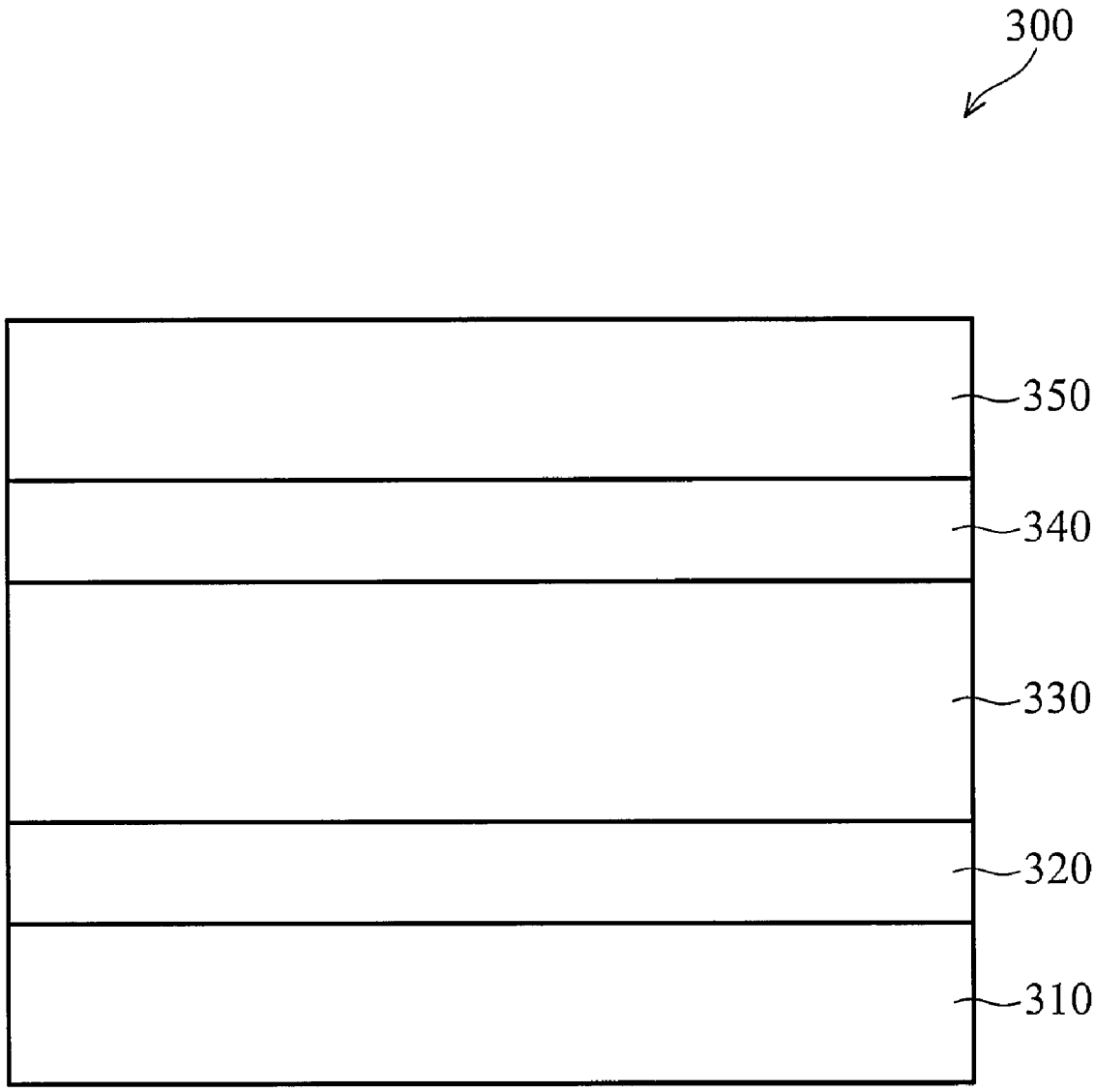
FIG. 6 is a schematic view of an embodiment of the dielectric substrate of the invention.

FIG. 6 is a schematic view of an embodiment of the dielectric substrate of the invention. A suitable dielectric substrate for embodiment of the invention comprises multi-layered substrates 300. The suspension inductor coil 200 is embedded in the multi-layered substrates 300. For example, the multi-layered substrates 300 includes a first dielectric layer 310 (e.g., 4 mil RO4403 dielectric material), a second dielectric layer 320 (e.g., 2 mil high dielectric constant material HiDK 20), a third dielectric layer 330 (e.g., 12 mil BT), a fourth dielectric constant layer 340 (e.g., 2 mil HiDK 20), and a fifth dielectric layer 350(e.g., 4 mil RO4403). The dielectric substrate comprises a polymer substrate, a ceramic substrate, or a semiconductor substrate, and the dielectric substrate can be made of singular material or a composite-substrate made of multiple materials. Moreover, the dielectric substrate comprises a circuit with at least one active device 470 or passive device 480, as shown in FIG. 7A.

According other embodiments of the invention, signal feed-back transmission lines on each layer of the dielectric substrate are wound such that the number of turns from an upper substrate to a signal feed-in hole in a lower substrate is less than one turn. More specifically, the suspension inductor device in the multiple substrates is formed as a completed spiral inductor. Furthermore, a conductive plug structure at the center of the suspension inductor device and the multiple substrates are configured as a completed spiral inductor such that the inductor coil extend towards a Z-direction, thereby forming a stereographic spiral inductor structure.

Figure 7A:
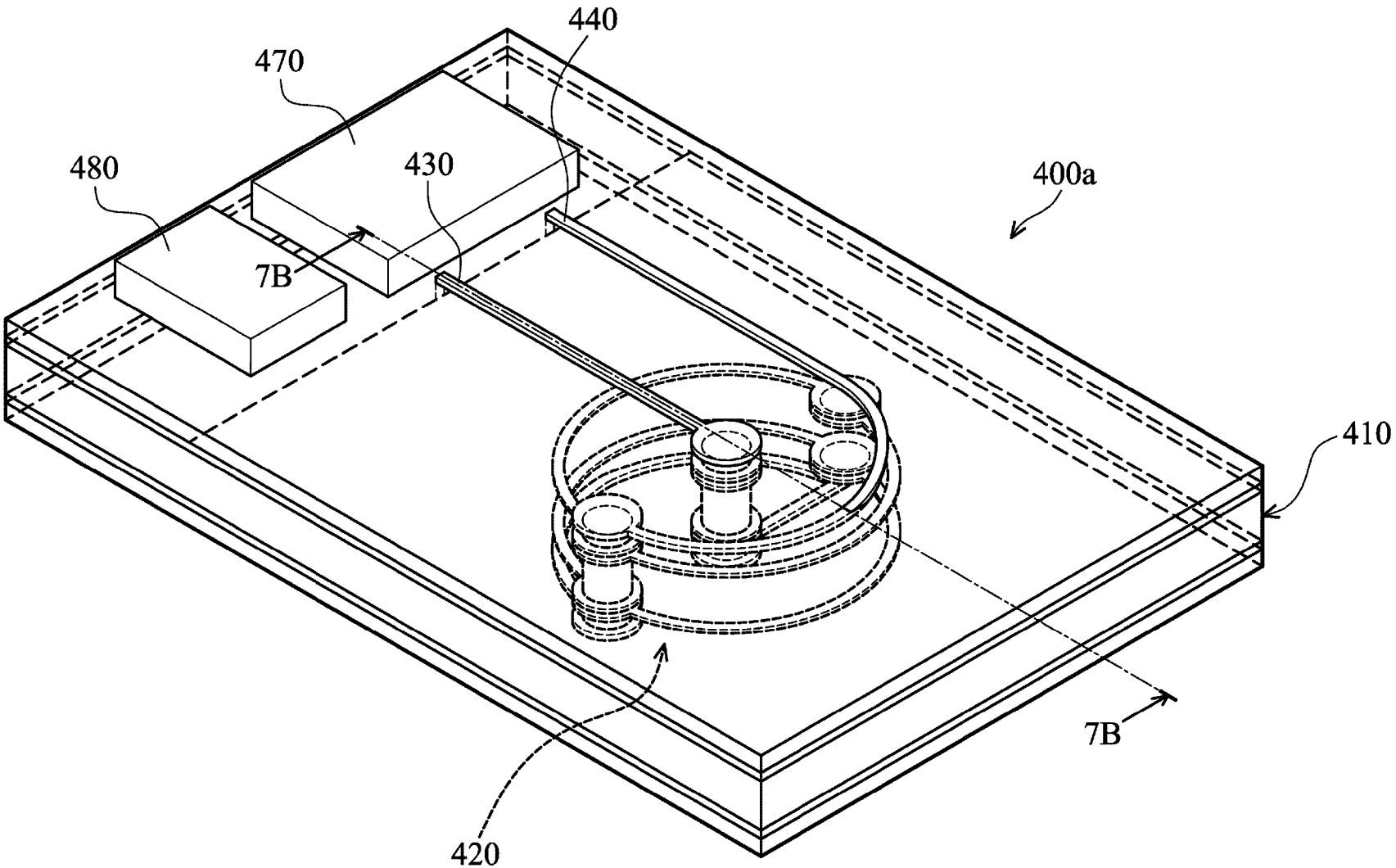
FIG. 7A is a schematic view of an embodiment of the suspension inductor device 400*a* of the invention.
Figure 7B:
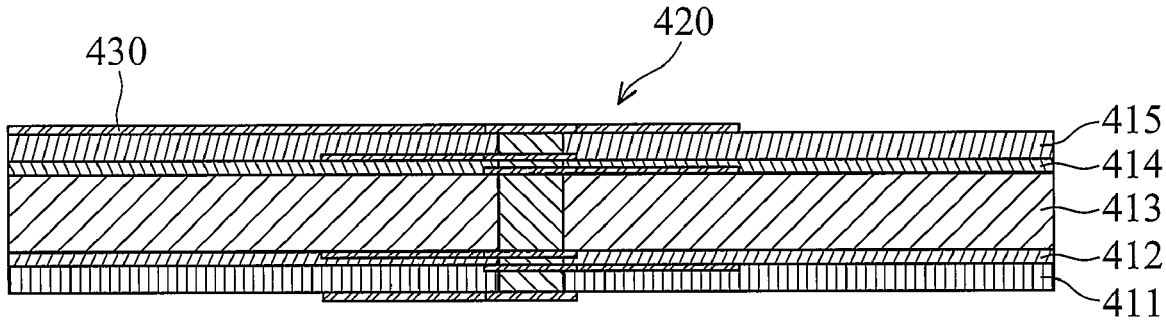
FIG. 7B is a cross section of the suspension spiral coil 420 of FIG. 7A taken along cutting line 7B-7B.

Referring to FIG. 7A, an embodiment of the invention provides a suspension inductor device 400*a* comprising a suspension spiral coil 420 embedded in the multi-layered dielectric substrates 410. An input end 430 is disposed on a first surface of the dielectric substrate 410 and is connected to the suspension spiral coil 420 through the interconnection at the central region of the suspension spiral coil 420. The suspension spiral coil 420 is wound upward connecting to the output end 440. FIG. 7B is a cross section of the suspension spiral coil 420 of FIG. 7A taken along cutting line 7B-7B. Referring to FIG. 7B, the multi-layered dielectric substrates 410 comprises five-layered sub-substrates 411-415. The input end 430 and output end 440 can be selectively and optionally disposed on the same or different layers of the sub-substrates. The outmost layer of the suspension spiral coil 420 is uncovered and exposed by the dielectric substrate 410. The input end 430 of the suspension spiral coil 420 is adjacent to the output end 440. The locations of input and output ends of the two-port inductor device can be easily changed to provide more design margins for system circuit layout.

Figure 8A:
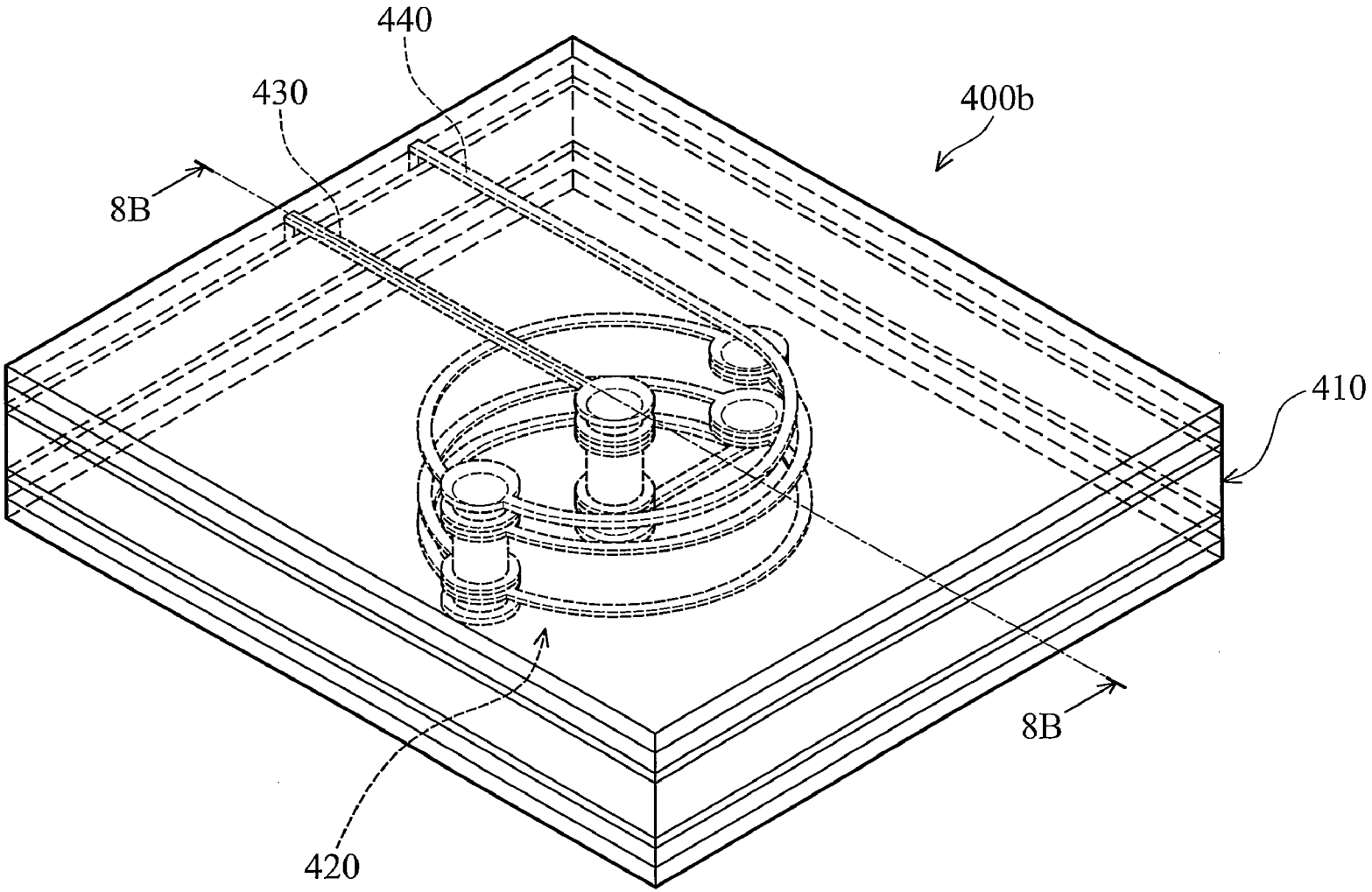
FIG. 8A is a schematic view of another embodiment of the suspension inductor device 400*b* of the invention.
Figure 8B:
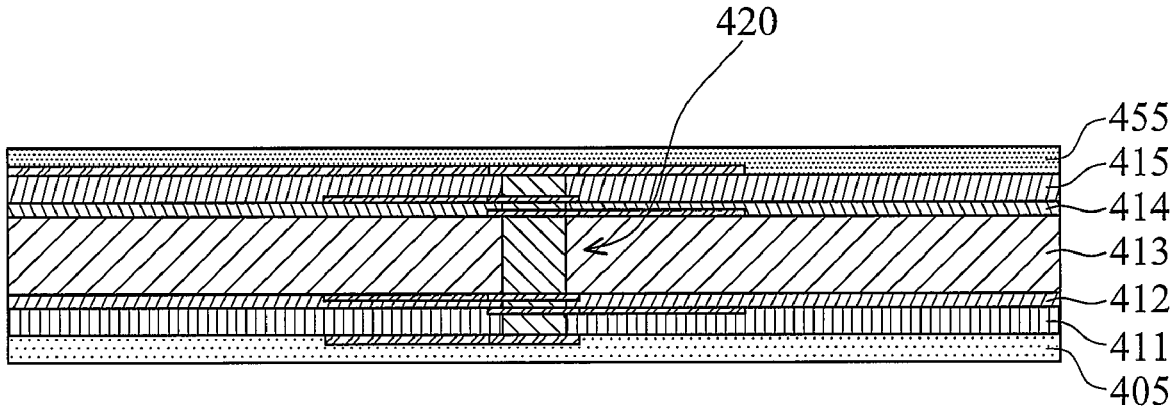
FIG. 8B is a cross section of the suspension spiral coil 420 of FIG. 8A taken along cutting line 8B-8B.

Referring to FIG. 8A, another embodiment of the invention provides a suspension inductor device 400*b* comprising a suspension spiral coil 420 embedded in the multi-layered dielectric substrates 410. An input end 430 is disposed on a first surface of the dielectric substrate 410 and is connected to the suspension spiral coil 420 through the interconnection at the central region of the suspension spiral coil 420. The suspension spiral coil 420 is wound upwards connecting to the output end 440. A cap layer 455 is disposed atop the multi-layered dielectric substrates 410, and a bottom layer 405 is disposed underlying the multi-layered dielectric substrates 410 (as shown in FIG. 8B). FIG. 8B is a cross section of the suspension spiral coil 420 of FIG. 8A taken along cutting line 8B-8B. Referring to FIG. 8B, the multi-layered dielectric substrates comprises five-layered sub-substrates 411-415. The input end 430 and output end 440 can be selectively and optionally disposed on the same or different layer of the sub-substrates. According to the abovementioned embodiments of the invention, the suspension inductor device is disclosed and exemplified with embedding in the dielectric substrate, but not limited thereto. Other features such as the input and output ends are not limited to being disposed on the surface of the substrate, or the suspension inductor device can be partially located on the surface or inner layer of the multi-layered dielectric substrates and the adjustments are not regarded as a departure from the spirit and scope of the invention.

Figure 9A:
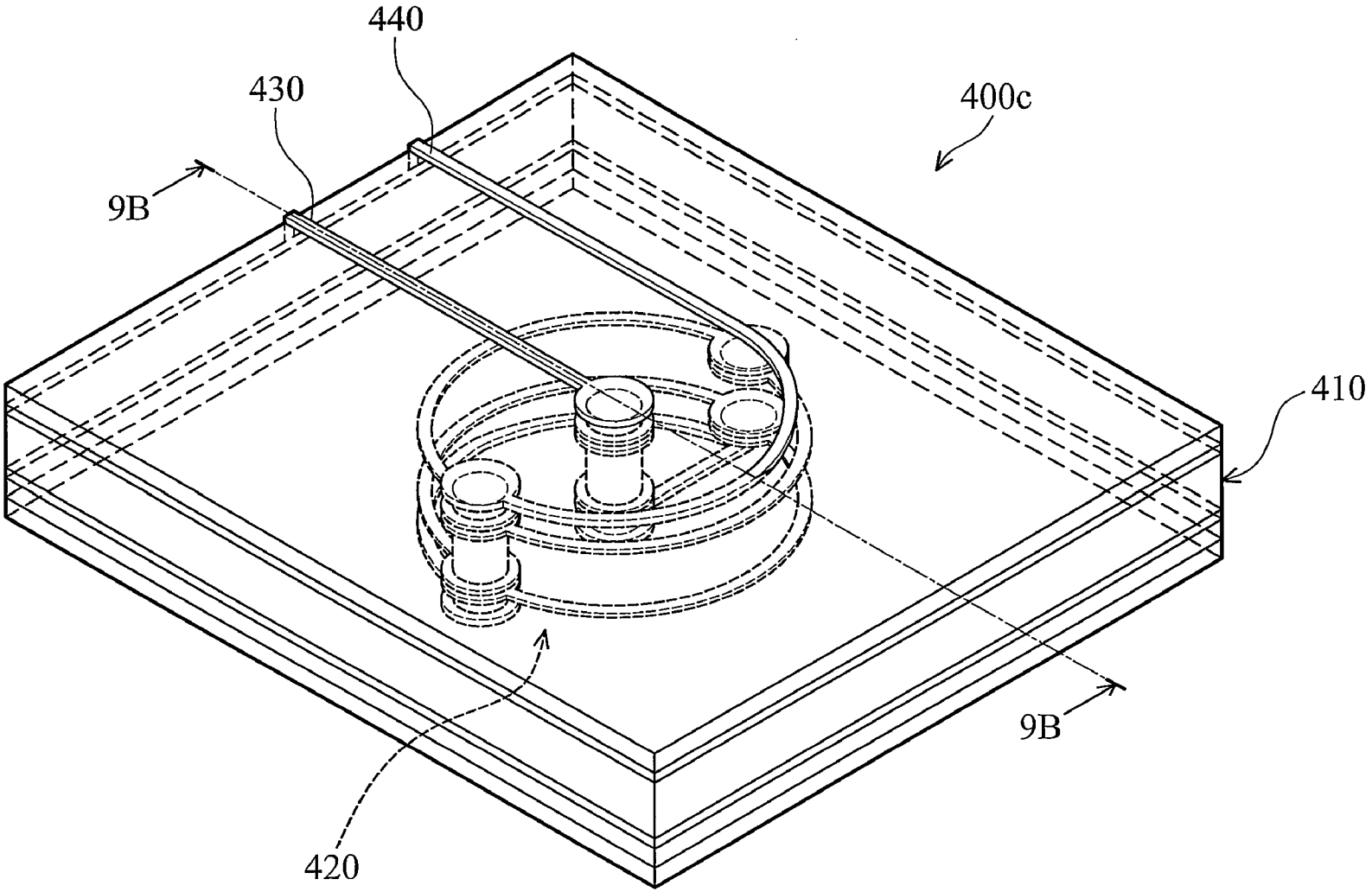
FIG. 9A is a schematic view of yet another embodiment of the suspension inductor device 400*c* of the invention.
Figure 9B:
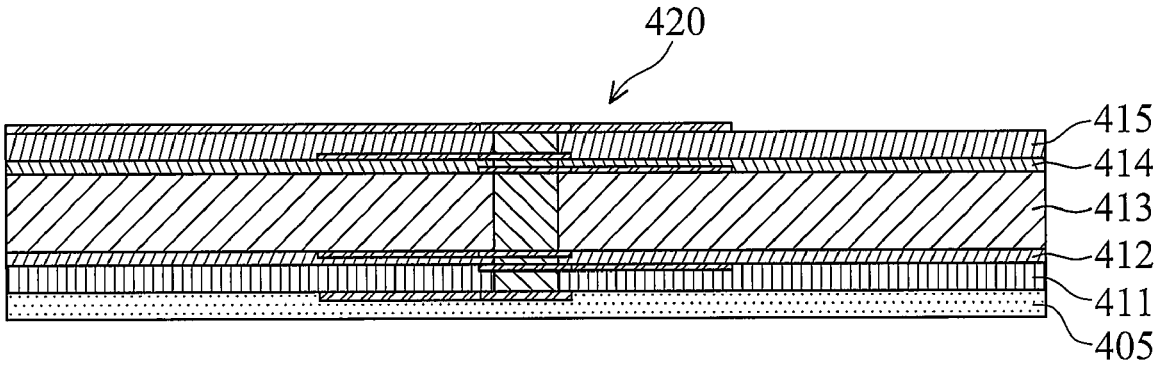
FIG. 9B is a cross section of the suspension spiral coil 420 of FIG. 9A taken along cutting line 9B-9B.

Referring to FIG. 9A, yet another embodiment of the invention of the invention provides a suspension inductor device 400*c* comprising a suspension spiral coil 420 embedded in the multi-layered dielectric substrates 410. An input end 430 is disposed on a first surface of the dielectric substrate 410 and is connected to the suspension spiral coil 420 through the interconnection at the central region of the suspension spiral coil 420. The suspension spiral coil 420 is wound upwards connecting to the output end 440. A bottom layer 405 is disposed underlying the multi-layered dielectric substrates 410 (as shown in FIG. 9B). FIG. 9B is a cross section of the suspension spiral coil 420 of FIG. 9A taken along cutting line 9B-9B. Referring to FIG. 9B, the multi-layered dielectric substrates 410 can be a five-layered sub-substrates 411-415. The input end 430 and output end 440 can be selectively and optionally disposed on the same or different layer of the sub-substrates. The topmost layer of the suspension spiral coil 420 is uncovered and exposed by the dielectric substrate 410, and the underlying layer of the suspension spiral coil 420 is embedded in the bottom layer 405.

Figure 10A:
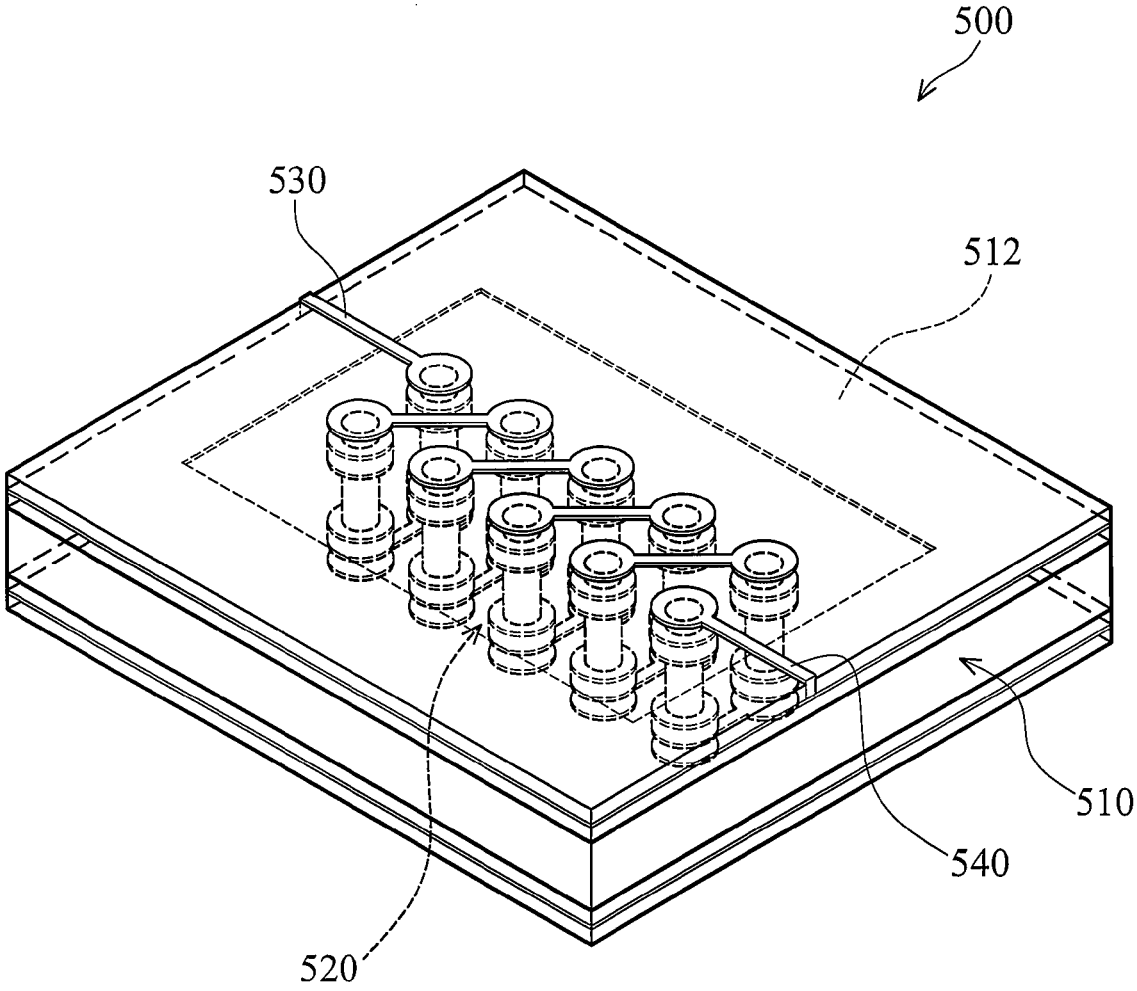
Figure 10B:
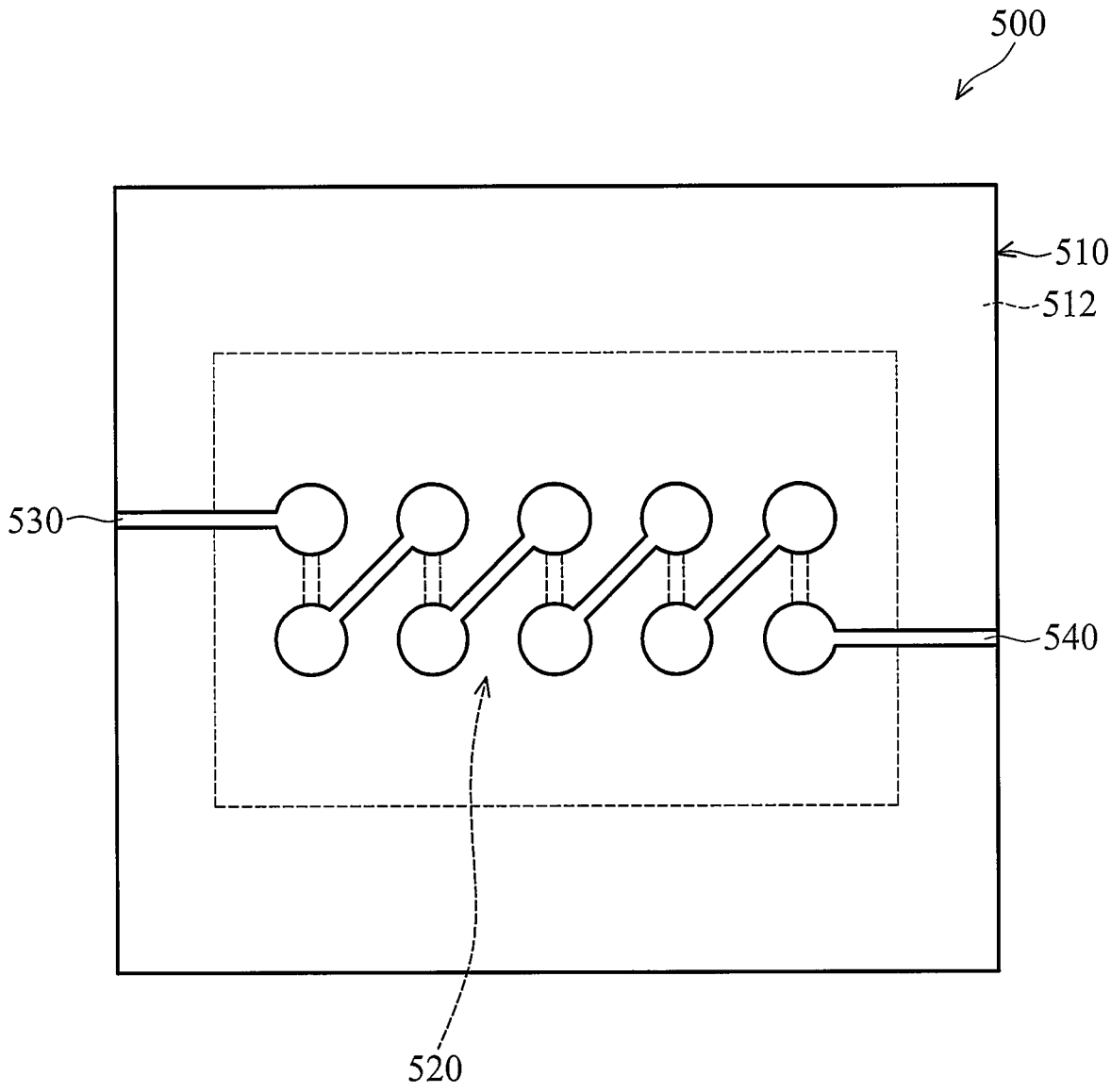
FIG. 10B is a plan view of the spiral inductor device of FIG. 10A.

FIG. 10A is a stereographic view of a conventional spiral inductor device, while FIG. 10B is a plan view of the spiral inductor device of FIG. 10A. Referring to FIG. 10A, a conventional spiral inductor device 500 includes a spiral inductor coil 520 embedded in the multi-layered dielectric substrates 510. An input end 530 and an output end 540 are disposed on a first surface of the dielectric substrate 510, and respective connect two terminals of the spiral inductor coil 520. Ground lines 512 are disposed at the peripheral area of the conventional spiral inductor device 500.

Figure 11A:
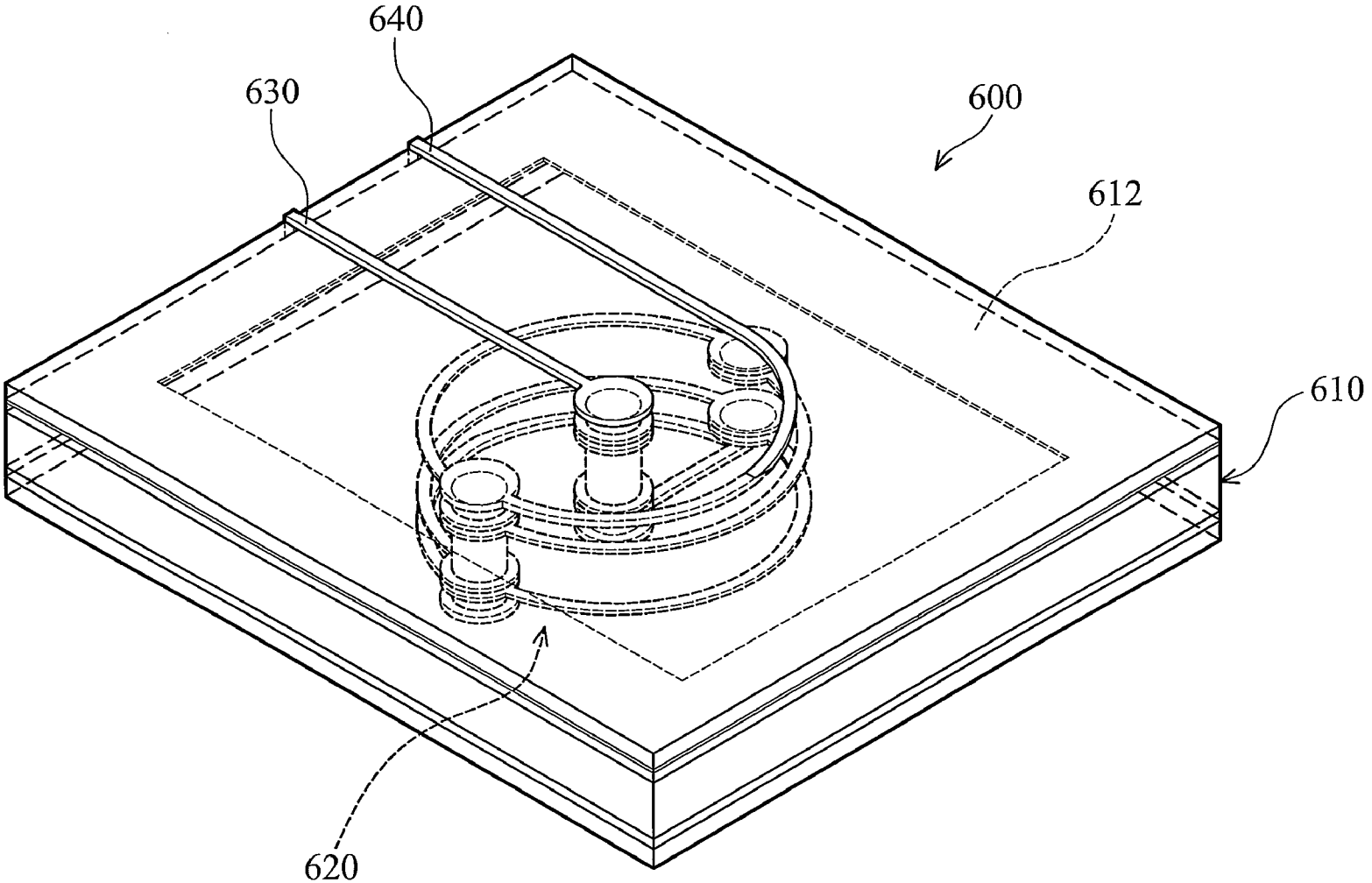
Figure 11B:
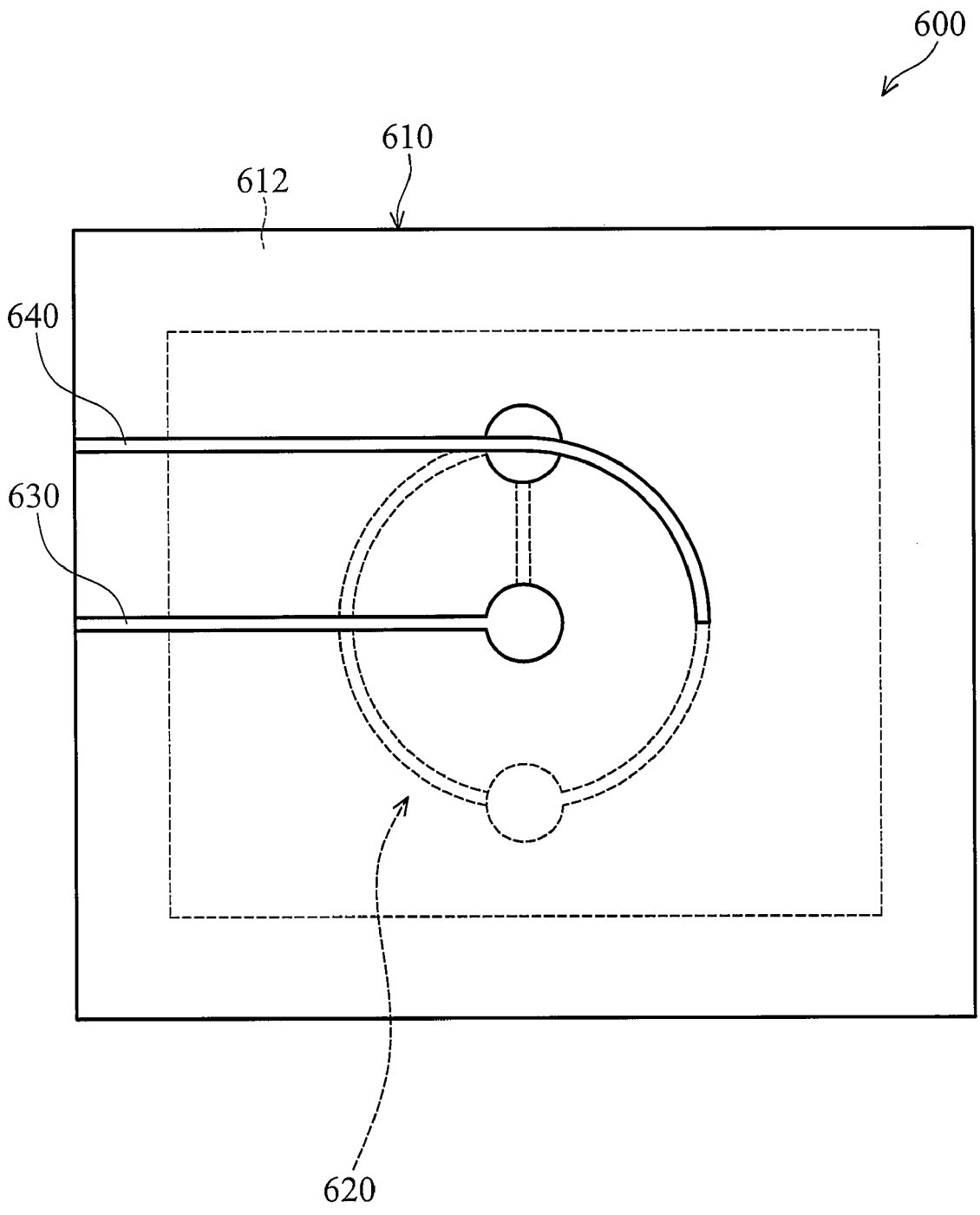
FIG. 11B is a plan view of the suspension spiral inductor device of FIG. 11A.

FIG. 11A is a stereographic view of one embodiment of the suspension spiral inductor device of the invention, while FIG. 11B is a plan view of the suspension spiral inductor device of FIG. 11A. Referring to FIG. 11A, the suspension spiral inductor device 600 includes a suspension spiral coil 620 embedded in multi-layered dielectric substrates 610. An input end 630 is disposed on a first surface of the dielectric substrate 610 and is connected to the suspension spiral coil 620 through the interconnection at the central region of the suspension spiral coil 620. The suspension spiral coil 620 is wound upward connecting to the output end 640. Ground lines 612 are disposed at the peripheral region of the suspension spiral inductor device 600.

Comparisons of inductance characteristics between the conventional spiral inductor device 500 and the suspension spiral inductor device 600 are listed in Table I.

TABLE I

| | layout area | inductance | maximum quality factor |
|---|---|---|---|
| suspension spiral inductor | 70 mil × 80 mil | 16.95 nH | 76.92 |
| conventional spiral inductor | 140 mil × 60 mil | 7.76 nH | 71.03 |

Figure 12A:
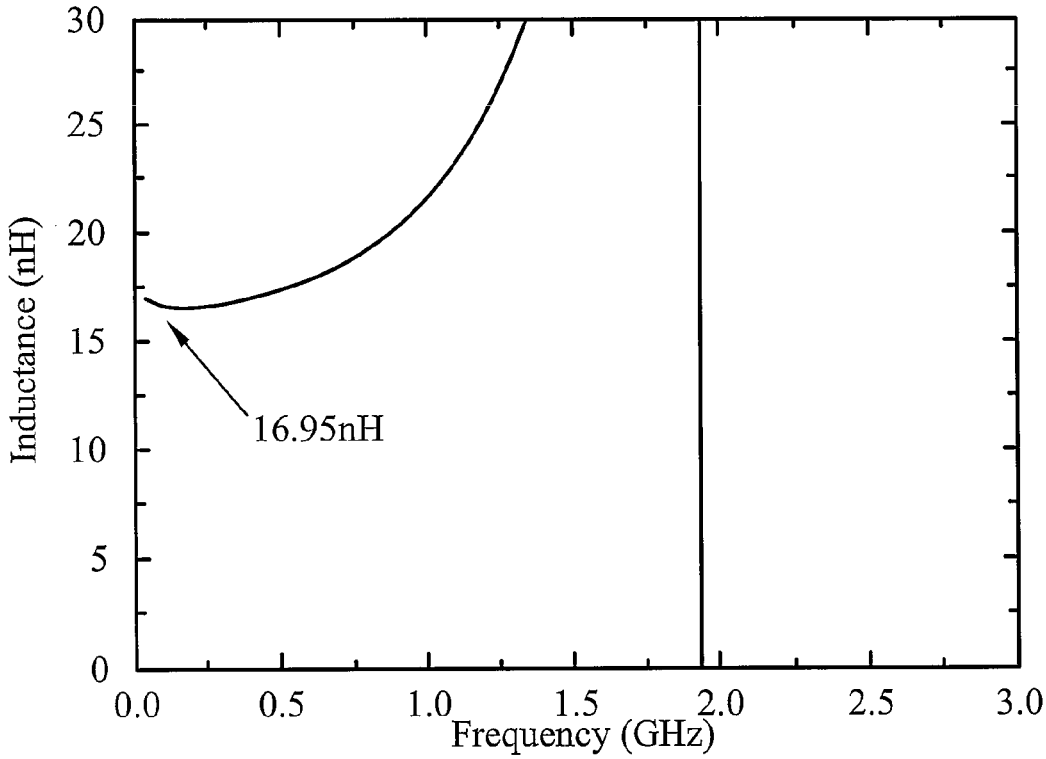
FIG. 12A shows relationship between inductance and frequency of the suspension spiral inductor device of the invention.
Figure 12B:
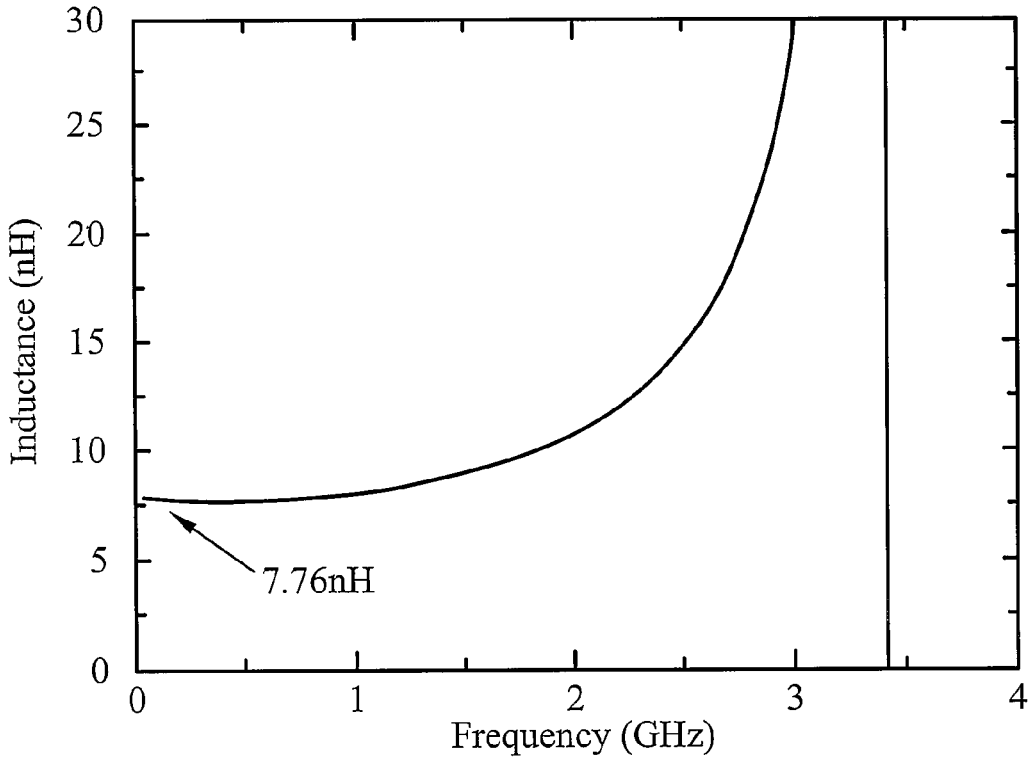
FIG. 12B shows relationship between inductance and frequency of the conventional spiral inductor device.
Figure 13A:
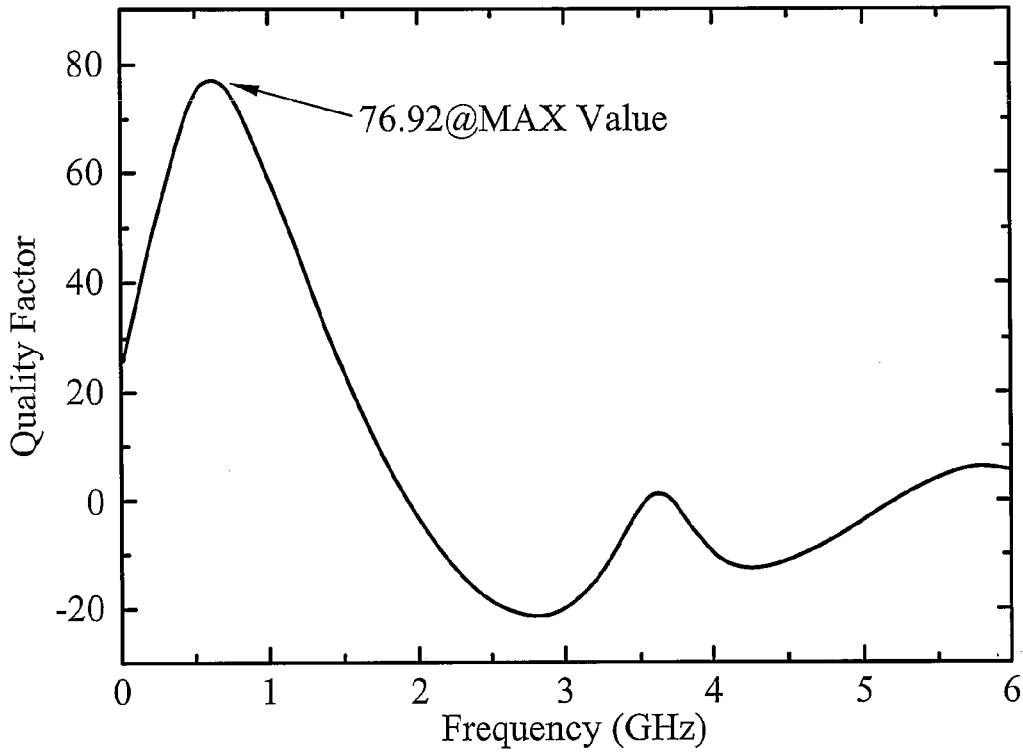
FIG. 13A shows relationship between quality factor and frequency of the suspension spiral inductor device of the invention.
Figure 13B:
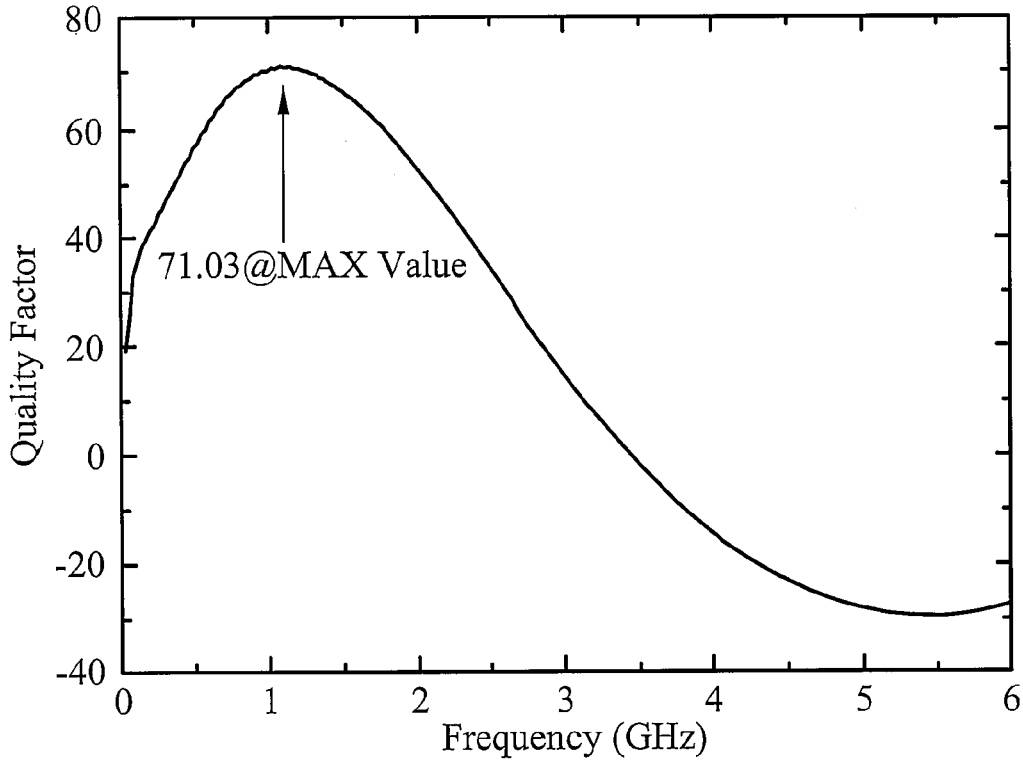
FIG. 13B shows relationship between quality factor and frequency of the conventional spiral inductor device.

The circuit layout area of the conventional spiral inductor device 500 is 140 mil×60 mil. The input end and output end are respectively disposed on different sides of the spiral inductor coil, thereby being detrimental to circuit layout design and making it difficult to integrate with other devices. Further referring to FIGS. 12B and 13B, the inductance of the conventional spiral inductor device 500 is 7.76 nH with maximum quality factor at 71.03, both of which are relatively low. Compared with embodiments of the invention, the circuit layout area of the suspension spiral inductor device 600 is 70 mil×80 mil. The input end and output end are disposed and respectively close to each other, thereby facilitating circuit layout design. Moreover, referring to FIGS. 12A and 13A, the inductance of the suspension spiral inductor device 600 is 16.95 nH with maximum quality factor at 76.92, both of which are improved compared with the conventional spiral inductor device 500.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A suspension inductor device, comprising:

a dielectric substrate having a top surface to a bottom surface; and a suspension induction coil, comprising:

an input end disposed on the top surface of the dielectric substrate;

a first interconnection passing through the dielectric substrate from the top surface to the bottom surface, wherein in the input end is connected to the first interconnection;

a conductive member disposed on the bottom surface of the dielectric substrate and connected to the first interconnection;

a solenoid coil comprising a plurality of coils of equal diameter wound gradually upwards through the dielectric substrate from the conductive member to the top surface of the dielectric substrate, wherein the first interconnection is disposed in the central area of the solenoid coil; and an output end disposed on the top surface of the dielectric substrate and connected to the solenoid coil, wherein the output end is adjacent to the input end.

2. The suspension inductor device as claimed in claim 1, wherein the dielectric substrate comprise a single-layered substrate made of singular material or a composite-substrate made of multiple materials.

3. The suspension inductor device as claimed in claim 1, wherein the dielectric substrate comprises a polymer substrate, a ceramic substrate, or a semiconductor substrate.

4. The suspension inductor device as claimed in claim 1, wherein the dielectric substrate comprises multiple layers of dielectric layers.

5. The suspension inductor device as claimed in claim 1, further comprising a bottom layer disposed underlying the dielectric substrate, wherein the first interconnection comprises a through hole, a blind hole, or a buried hole between different dielectric layers.

6. The suspension inductor device as claimed in claim 1, further comprising a top layer disposed overlying the dielectric substrate, wherein the first interconnection comprises a through hole, a blind hole, or a buried hole between different dielectric layers.

7. The suspension inductor device as claimed in claim 1, further comprising a bottom layer disposed underlying the dielectric substrate and a top layer disposed overlying the dielectric substrate respectively, wherein the first interconnection comprises a through hole, a blind hole, or a buried hole between different dielectric layers.

8. The suspension inductor device as claimed in claim 1, wherein the dielectric substrate comprises a circuit with at least one active device or passive device.

9. The suspension inductor device as claimed in claim 1, wherein the dielectric substrate comprises a stacking structure with multi-layers of sub-substrates.

10. The suspension inductor device as claimed in claim 9, wherein the solenoid coil comprises at least one turn of coil, any coil having a winding segment on one of the sub-substrates, a conductive hole passing through the sub-substrate connecting to a winding segment of the next turn of coil, assembling a completed solenoid coil by coils on different layers and blind-buried holes.

11. The suspension inductor device as claimed in claim 9, wherein the solenoid coil comprises a plurality turns of coil, wherein the input end and the output end are disposed on different sub-substrates respectively.

12. The suspension inductor device as claimed in claim 1, wherein the first interconnection is disposed with an inner area of the solenoid coil.

13. The suspension inductor device as claimed in claim 1, wherein the first interconnection is made of electrically conductive materials or magnetic permeable materials.

14. The suspension inductor device as claimed in claim 1, wherein the solenoid coil comprises a rectangular spiral coil, a polygonal spiral coil, or a circular solenoid coil.

15. The suspension inductor device as claimed in claim 1, wherein the solenoid coil is clockwise wound or counter-clockwise wound.

16. The suspension inductor device as claimed in claim 1, further comprising signal feed-back transmission lines on each layer of the dielectric substrate wound such that the number of turns from an upper substrate to a signal feed-in hole in a lower substrate is less than one turn.

17. The suspension inductor device as claimed in claim 1, wherein the suspension inductor device in the multiple substrates is formed as a completed solenoid inductor.

18. The suspension inductor device as claimed in claim 1, wherein a conductive plug structure at the center of the suspension inductor device and the multiple substrates are configured as a completed solenoid inductor such that the inductor coil extends towards a Z-direction, thereby forming a stereographic solenoid inductor structure.

19. A suspension inductor device, comprising:

a dielectric substrate with a multilayer of sub-substrates, wherein the dielectric substrate has a top surface and a bottom surface;

an input end disposed on the top surface of dielectric substrate;

a first interconnection passing through the dielectric substrate from the top surface to the bottom surface, wherein the input end is connected to the first interconnection;

a conductive member disposed on the bottom surface of the dielectric substrate and connected to the first interconnection;

a solenoid coil comprising a plurality of coils of equal diameter wound through the dielectric substrate from the conductive member to the top surface of the dielectric substrate, wherein each coil has a winding segment on one of the sub-substrates, and a conductive hole passing through the sub-substrate connects to a winding segment of the next coil, and wherein the first interconnection is disposed in the central area of the solenoid coil; and an output end disposed on the top surface of the dielectric substrate and connected to the solenoid coil, wherein the output end is adjacent to the input end.

20. The suspension inductor device as claimed in claim 19, wherein the dielectric substrate comprises a polymer substrate, a ceramic substrate, or a semiconductor substrate, and wherein the dielectric substrate comprise a single-layered substrate made of singular material or a composite-substrate made of multiple materials.

21. The suspension inductor device as claimed in claim 19, wherein the dielectric substrate comprises multiple layers of dielectric layers.

22. The suspension inductor device as claimed in claim 19, further comprising a bottom layer disposed underlying the dielectric substrate, wherein the first interconnection comprises a through hole, a blind hole, or a buried hole between different dielectric layers.

23. The suspension inductor device as claimed in claim 19, further comprising a top layer disposed overlying the dielectric substrate, wherein the first interconnection comprises a through hole, a blind hole, or a buried hole between different dielectric layers.

24. The suspension inductor device as claimed in claim 19, further comprising a bottom layer disposed underlying the dielectric substrate and a top layer disposed overlying the dielectric substrate respectively, wherein the first interconnection comprises a through hole, a blind hole, or a buried hole between different dielectric layers.

25. The suspension inductor device as claimed in claim 19, wherein dielectric substrate comprises a circuit with at least one active device or passive device.

26. The suspension inductor device as claimed in claim 19, wherein the solenoid coil comprises a plurality turns of coil, wherein the input end and the output end are disposed on different sub-substrates respectively.

27. The suspension inductor device as claimed in claim 19, wherein the first interconnection is disposed with an inner area of the solenoid coil.

28. The suspension inductor device as claimed in claim 19, wherein the first interconnection is made of electrically conductive materials or magnetic permeable materials.

29. The suspension inductor device as claimed in claim 19, wherein the solenoid coil comprises a rectangular solenoid coil, a polygonal solenoid coil, or a circular solenoid coil.

30. The suspension inductor device as claimed in claim 19, wherein the solenoid coil is clockwise wound or counter-clockwise wound.

31. The suspension inductor device as claimed in claim 19, further comprising signal feed-back transmission lines on each layer of the dielectric substrate wound such that the number of turns from an upper substrate to a signal feed-in hole in a lower substrate is less than one turn.

32. The suspension inductor device as claimed in claim 19, wherein the suspension inductor device in the multiple substrates is formed as a completed solenoid inductor.

33. The suspension inductor device as claimed in claim 19, wherein a conductive plug structure at the center of the suspension inductor device and the multiple substrates are configured as a completed solenoid inductor such that the inductor coil extends towards a Z-direction, thereby forming a stereographic solenoid inductor structure.

34. The suspension inductor device as claimed in claim 1, further comprising second interconnection connecting each of the plurality of coils of the solenoid coil.

35. The suspension inductor device as claimed in claim 19, further comprising second interconnection connecting each of the plurality of coils of the solenoid coil.

* * * * *